US006053767A

United States Patent [19]

Copper et al.

[11] Patent Number: 6,053,767

[45] Date of Patent: Apr. 25, 2000

[54] HOLD DOWN FOR AN ELECTRICAL CONNECTOR

[75] Inventors: Charles Dudley Copper; Wayne Samuel Davis, both of Harrisburg; Keith Scott Koegel, Plainfield; Jared Joseph Smalley, Jr., Harrisburg, all of Pa.

[73] Assignee: The Whitaker Corporation, Wilmington, Del.

[21] Appl. No.: 09/215,443

[22] Filed: Dec. 18, 1998

[51] Int. Cl.[7] ..... H01R 13/60

[52] U.S. Cl. ..... 439/567; 439/570

[58] Field of Search ..... 439/567, 570, 439/563

[56] References Cited

U.S. PATENT DOCUMENTS

| | | | |
|---|---|---|---|
| 4,668,040 | 5/1987 | Matsuzaki et al. | 439/567 |
| 4,721,473 | 1/1988 | DelGuidice et al. | 439/79 |
| 5,096,440 | 3/1992 | Katsumata | 439/570 |
| 5,120,256 | 6/1992 | Walden | 439/553 |
| 5,145,407 | 9/1992 | Obata et al. | 439/567 |
| 5,318,464 | 6/1994 | DiMondi et al. | 439/553 |
| 5,395,265 | 3/1995 | DiMondi et al. | 439/553 |
| 5,704,807 | 1/1998 | Sherman et al. | 439/570 |
| 5,827,089 | 10/1998 | Beck, Jr. et al. | 439/567 |
| 5,857,871 | 1/1999 | Horchler | 439/567 |
| 5,865,645 | 2/1999 | Embo et al. | 439/567 |

*Primary Examiner*—Steven L. Stephan
*Assistant Examiner*—J. F. Duverne

[57] ABSTRACT

The invention is directed to an electrical connector (10) including a housing (12) with a mating face (16), a rear face (18) opposite to the mating face (16), a side (20), and an end (26), the end (26) having a holding feature (30) thereon. The housing (12) is mountable onto a surface of a substrate with either the rear face (18) or the [mating face] side (20) being placed against the surface. A hold down (40) is securable to the housing feature (30). The hold down (40) has a substrate securing portion (42) and housing securing portion (46). The housing securing portion (46) is securable to the holding feature (30) in at least two orientations to secure the housing (12) to the substrate when it is mounted in either orientation.

18 Claims, 5 Drawing Sheets

HOLD DOWN FOR AN ELECTRICAL CONNECTOR

FIELD OF THE INVENTION

This invention is related to a mounting device for locking or securing a component such as an electrical connector to a circuit board or some other panel.

BACKGROUND OF THE INVENTION

There are numerous ways of securing an electrical connector to a circuit board or some other panel. For example, the connector may be provided with mounting flanges having bores that align with corresponding apertures on the circuit board. Fasteners can be extended through the bore and the board aperture to secure the connector thereto.

In other arrangements, such as disclosed in U.S. Pat. No. 5,145,407, a holding device is inserted through an opening in a component and has resilient legs for engaging the circuit board and securing the circuit board to the component. The mounting device includes one portion having a latch extending angularly from the plane of the mounting device. Further, the mounting device has barbs for securing the mounting device with the component. The mounting device also has legs with a first portion which is tapered outwardly and a second portion which is tapered inwardly to provide spring action transverse to the plane of the mounting device and to engage the circuit board.

Electrical connectors can be mounted to a circuit board in different orientations. One orientation is where the mating face of the electrical connector is parallel to the surface of the circuit board. An alternative orientation is where the mating face of the electrical connector is perpendicular to the circuit board, this is referred to as a right angle connector. Typically, the electrical connectors must be individually designed for either parallel mounting or right angle mounting and the hold downs that are used for these connectors must be individually designed.

What is needed is a hold down which can secure an electrical connector in either orientation to the circuit board or to a panel.

SUMMARY OF THE INVENTION

The invention is directed to an electrical connector including a housing with a mating face, a rear face opposite to the mating face, a side, and an end, the end having a holding feature thereon. The housing is mountable onto a surface of a substrate with either the rear face or the mating face being placed against the surface. A hold down is securable to the holding feature. The hold down has a substrate securing portion and housing securing portion. The housing securing portion is securable to the holding feature in at least two orientations to secure the housing to the substrate when it is mounted in either orientation.

The invention is further directed to a hold down for an electrical connector wherein the electrical connector has a rear face, a side, and an end, the end having a protrusion for engaging the hold down. A housing securing member and a substrate securing member extend from the housing securing member. The housing securing member has arms which engage the protrusion such that the securing member can be mounted on the protrusion in a first direction where the substrate securing member extends towards the side and in a second direction where the substrate securing member extends towards the rear face.

BRIEF DESCRIPTION OF THE DRAWINGS

Embodiments of the invention will now be described with reference to the accompanying drawings, in which.

DETAILED DESCRIPTION OF EMBODIMENTS OF THE INVENTION

Figure 1:
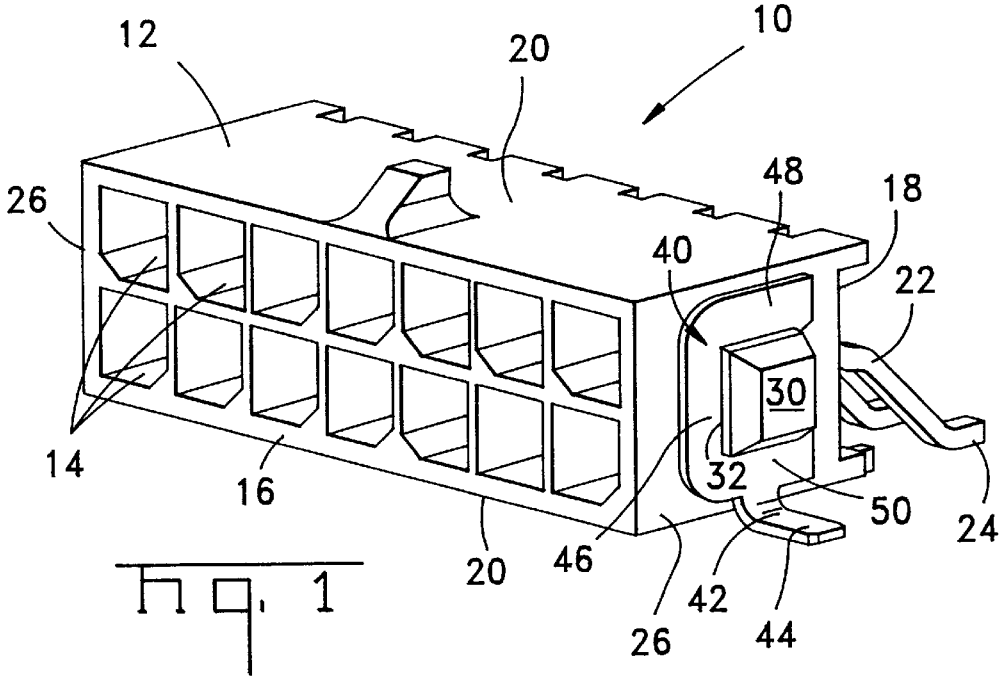
FIG. 1 is an isometric view of the electrical connector and the hold down of the present invention.

FIG. 1 shows an electrical connector 10 which is to be mounted to a circuit board, not shown. The circuit board is a typical circuit board having a surface onto which the electrical connector 10 is to be mounted. The circuit board will have electrical pads for providing connection from the electrical connector 10 to the circuit on the board. The circuit board will also have a feature to engage the electrical connector to secure the connector thereon. The feature will either be a through hole or a surface mount pad. While the invention is described whereby the connector is secured to a circuit board, it is also within the scope of the invention that the electrical connector would be mounted on some type of panel using similar features, such as through holes or surface mount holding features.

The electrical connector 10 is made up of a dielectric housing 12 having a plurality of contact receiving cavities 14 extending therethrough. The housing has a mating face 16 and an opposite rear face 18 and sidewalls 20. Contacts 22 are mounted within the contact receiving cavities 14 and have surface mounted tails 24 to provide electrical connection to pads on the circuit board, not shown.

Figure 2:
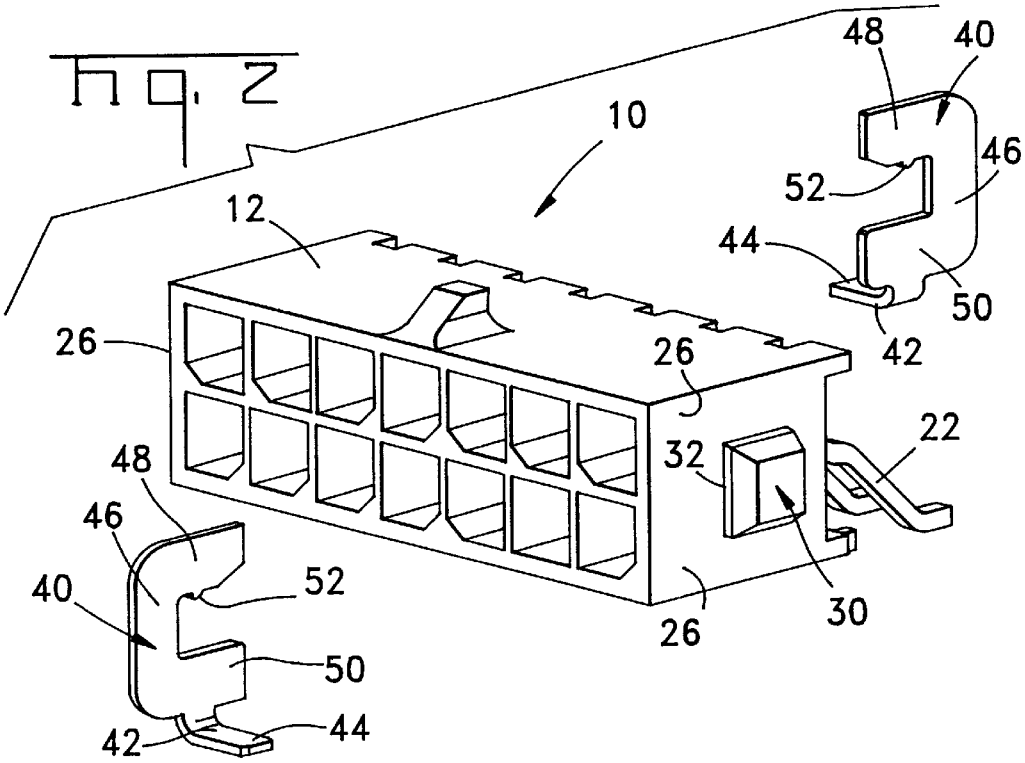
FIG. 2 is an exploded isometric view of the electrical connector and hold down.

The housing 12 has end walls 26 having the hold down mounting feature 27 thereon. The hold down mounting feature 27 includes a mounting feature on the housing and a hold down being securable to the mounting feature. The hold down mounting feature 27 comprises a protrusion 30 having a groove 32 extending around the periphery of the protrusion 30. In this embodiment, the protrusion 30 is square. The hold down 40, which is also shown in FIG. 2, includes a board mount member 42, which is shown as a surface mount leg 44. The hold down 40 is securable to the protrusion 30 and has a generally C-shaped portion 46 having an upper arm 48 and a lower arm 50. Along the internal edges 49, 51 of the arms 48, 50 are barbs 52 which help secure the hold down 40 to the protrusion 30. The arms 48, 50 are resilient and provide a secure fit against protrusion 30 to secure the hold down member 40 onto the protrusion 30.

The hold down 40 is secured onto the housing 12 by sliding the hold down 40 from left to right, as shown in FIG. 1, so that the arms 48, 50 are received within the groove 32 and grippingly secure the hold down 40 on the groove 32 and the protrusion 30. The opposite end wall 26 also has a protrusion 30 and a hold down member secured thereon. The hold down member 40 can be used as shown in FIG. 2, on the opposite end 26 the hold down member would be slid from right to left so that the securing leg 44 is extending away from the housing 12. Alternatively, the hold down members 40, on opposite ends of the housing 12, could be formed in mirror images of each other, not shown, so that the hold downs 40 could both be slid onto the protrusions 30 from the same direction, for instance from either the mating face 16 or from the rear face 18. An advantage of having the hold downs 40 as shown is FIG. 2 is that only one part need to be stocked for securing both ends of the connector 10.

Once the hold down member is secured onto the housing 12, the electrical connector 10 can then be secured to the printed circuit board by soldering the securing legs 44 of the hold down member 40 to pads on the circuit board, not shown. At that point, the solder tails 24 of the contact 22 can also be secured to contact pads on the board.

Figure 3:
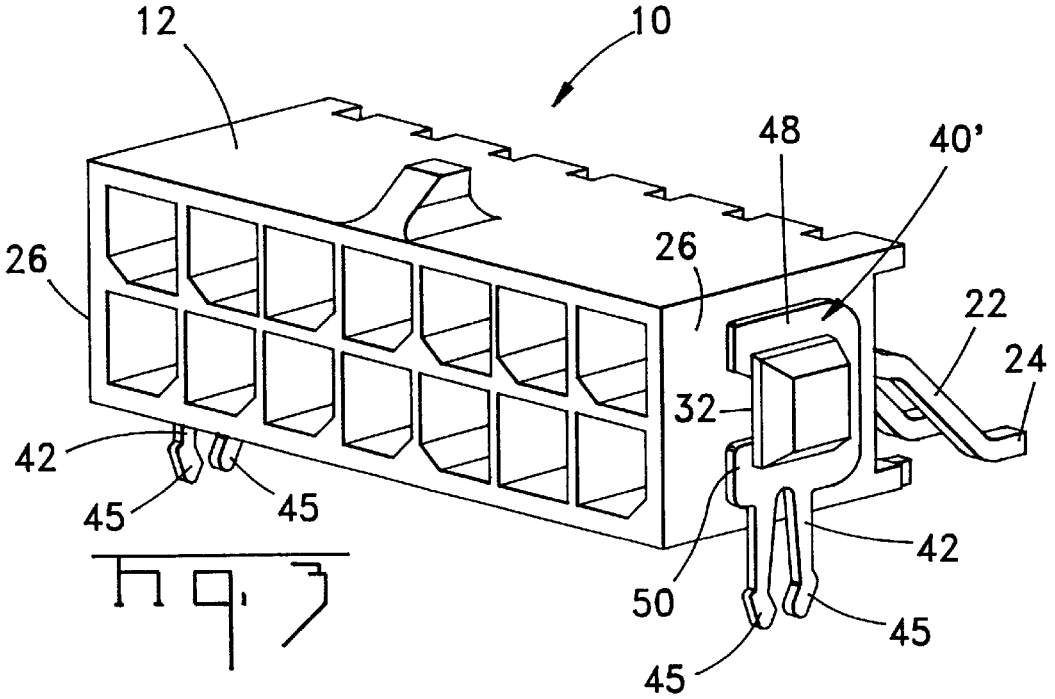
FIG. 3 is an isometric view of an alternative embodiment of the hold down.

An alternative embodiment 40' to the hold down 40 is shown in FIG. 3, in which like features will have the same reference numeral. The hold down 40' shown in FIG. 3 has the same C-shaped member 46 having upper and lower arms 48, 50. The securing portion 42 is a pair of legs 45 which are received into a hole in the board. The legs 45 are resilient and will engage against walls in the hole on the board to secure the connector to the board. Therefore, the hold down 40' shown in FIG. 3 can be used to secure to same electrical connector as shown in FIG. 1 onto a board which requires a through hold down. The hold down 40' is mounted to the housing 12 in the same manner. Since the hold down 40' shown in FIG. 3 is flat, it can be slid onto the protrusion from either direction, therefore, only one part is required for mounting from either direction.

Figure 4:
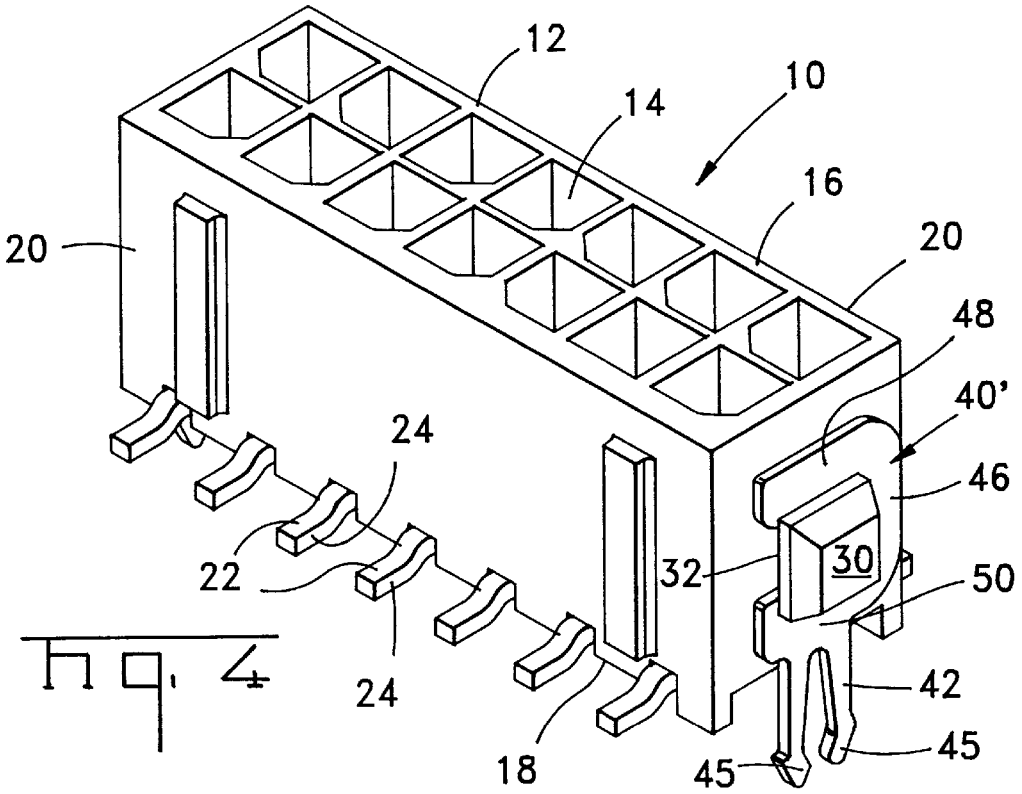
FIG. 4 is an isometric view of an electrical connector mounted in different orientation.

FIG. 4 shows an alternative mounting arrangement for the electrical connector 10. The connector housing 12 is the same housing as is shown in FIGS. 1, 2 and 3, the difference being that the contacts 22 are different contacts when mounted within the housing 12 so that the electrical connector 10 functions as a straight through, surface mount connector rather than the right angle connector shown in FIGS. 1, 2 and 3. In other words, the rear face 18 is mounted against the surface of the printed circuit board, not shown, so that the mating face 16 is opposite from the circuit board. This arrangement of the electrical connector 10 can be secured to the board using the same hold down 40 or 40' as was disclosed in either FIGS. 1, 2 or in FIG. 3. Since the protrusion 30 is square and has groove 32 extending all around, the hold down 40' can be mounted in either the orientation shown in FIG. 3, for a right angle connector, or the orientation shown in FIG. 4 for a straight through connector. Alternatively, the hold down 40 shown in FIGS. 1 and 2 could also be used to secure the electrical connector in the orientation shown in FIG. 4. The hold down 40 shown in FIGS. 1 and 2 can be secured in either arrangement either for a right angle connector or for a straight through connector.

Figure 5:
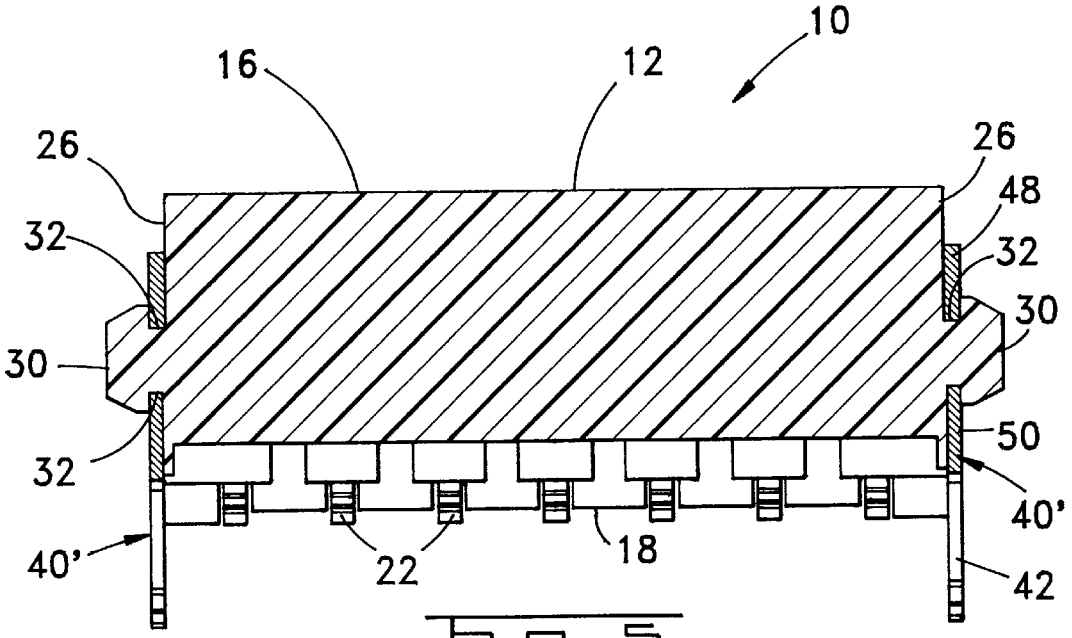
FIG. 5 is a cross-sectional view of the electrical connector shown in FIG. 4.

FIG. 5 shows a cross sectional view of the electrical connector shown in FIG. 4. In this view, it is clear that the protrusions 30 have grooves 32 and that the arms 48, 50 of the hold down 40 are received within those grooves and a gripping interaction secures the hold down 40 to the protrusion 30.

Figure 6:
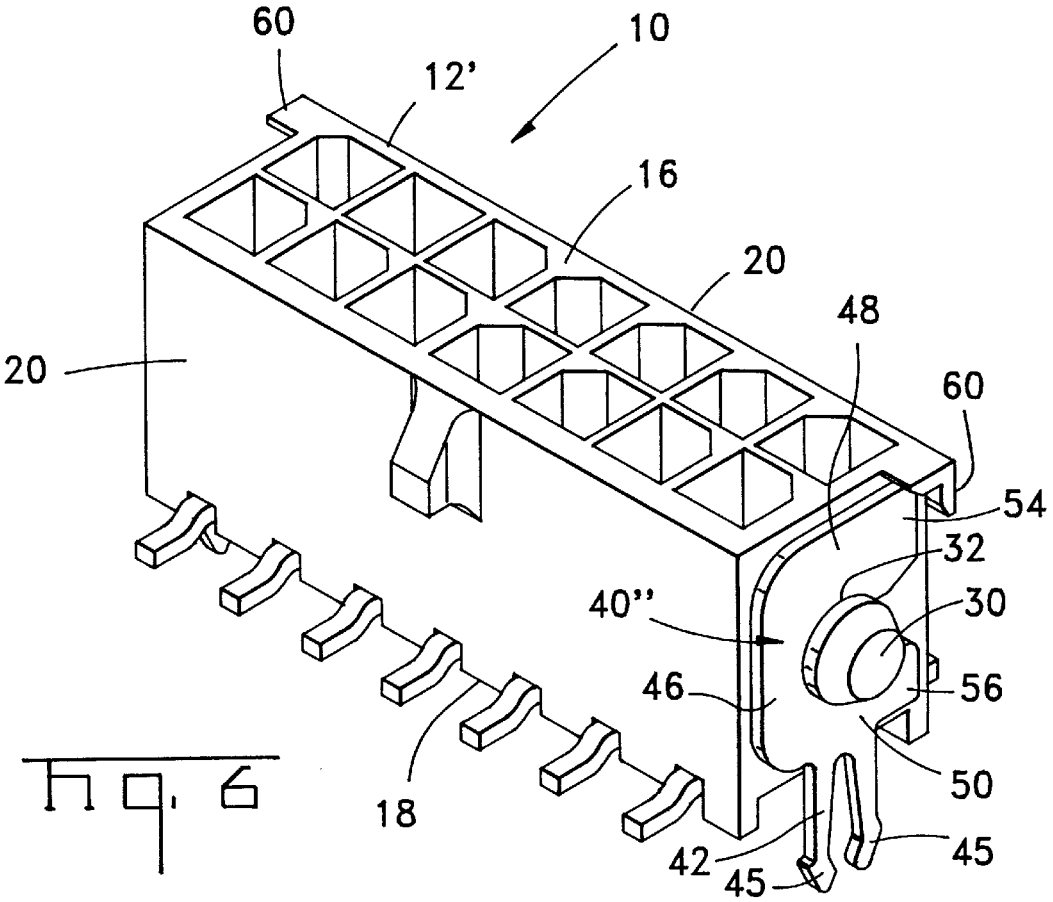
FIG. 6 is an alternative embodiment of the electrical connector and the hold down.

FIG. 6 is an alternative embodiment 40" of the hold down 40. The hold down 40 shown in FIG. 6 can be used on the same housing 12 as described earlier with small modification. The difference between the holding feature 27 is that the protrusion 30 is circular in shape and has a circular groove extending therearound. Consequently, hold down 40" has a circular interior between upper arm 48 and lower arm 50. The upper arm 48 and lower arm 50 also snap onto the protrusion 30 within the grooves 32 to provide a gripping interaction with the protrusion 30. One further difference is that the housing 12' has corner member 60 disposed at a corner between the mating face 16 and side 20. The hold down 40" has corners 54, 56. Since the protrusion 30 is circular and the interior surface of the hold down member is circular, the hold down 40 member would be free to rotate about the protrusion 30 without the corner member 60. In order to keep the hold down from rotating, the corner 54 of the hold down member 40" is received within the corner member 60 thereby preventing rotation of the hold down member 40. If the electrical connector 10 is used in a right angle version, similar to that which was shown in FIG. 1, the hold down 40" would be mounted on the housing 12' at a right angle to that which is shown in FIG. 6. In that case corner 56 would be received within the corner member 60 thereby also preventing rotation of the hold down 40'.

Figure 7:
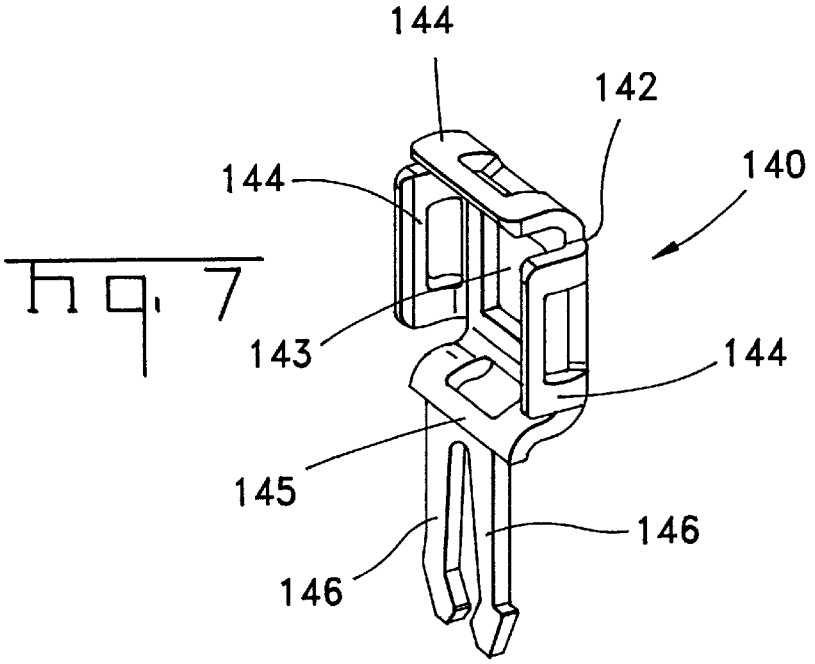
FIG. 7 is an isometric view of an alternative embodiment of the hold down.
Figure 8:
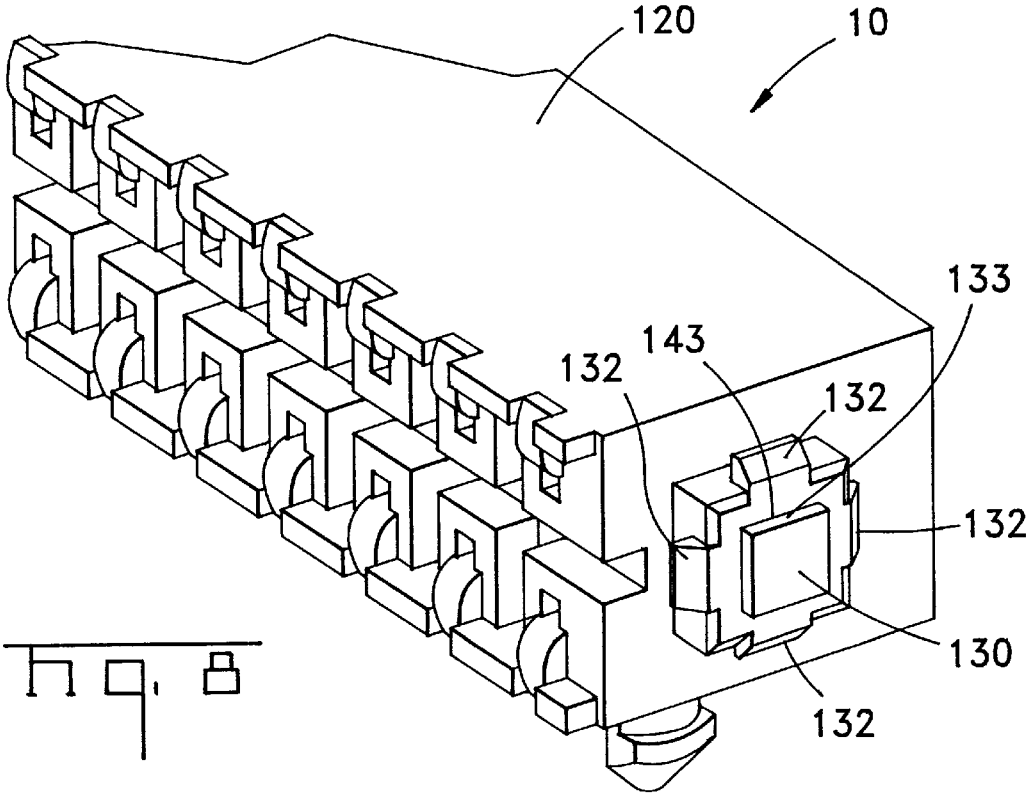
FIG. 8 is an isometric view of the housing to be used with the hold down in FIG. 7.
Figure 9:
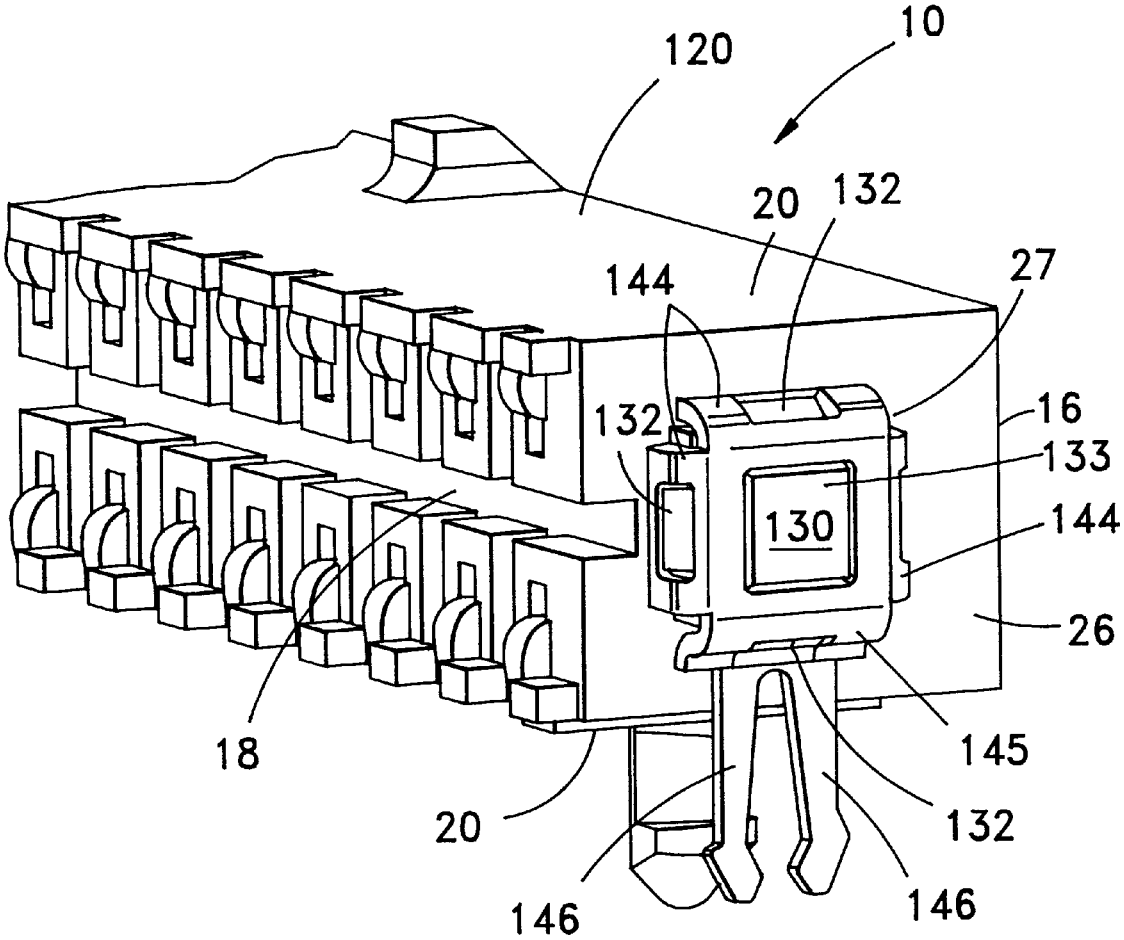
FIG. 9 is an isometric view of the hold down mounted to the housing.

FIGS. 7–9 show an alternative embodiment of the holding feature 27 on the electrical connector 10. The housing 120, shown in FIGS. 8 and 9 has a protrusion 130 which is square in shape. Along each side of the protrusion are latching lugs 132. In the center of the protrusion 130 is a square embossment 133.

The hold down 140, shown in FIG. 7, has a square section 142 with latches 144, 145 extending from each side of the square section 142. In the center of the square section 142 is a square opening 143. Latch 145 has securing legs 146 extending therefrom. The legs 145 are designed to be received within a hole in the circuit board or panel. Alternatively, the hold down 140 could have a surface mount leg extending from latch 145.

When the hold down 140 is secured to the protrusion 130, the latches 144, 145 are each received over a latching lug 132 to secure the hold down 140 to the housing 12. The square embossment 133 is received within the square opening 143 to further stabilize the hold down 140. The hold down 140 can then be used to secure the housing to the board or the panel.

As was described in the earlier embodiments, the hold down 140 can be mounted onto the protrusion 130 in different orientations. The hold down 140 can be mounted onto the protrusion 130 so that the connector can be mounted to the board in a right angle orientation, as show in FIG. 9. Alternatively, the connector can be mounted in a straight through orientation as described above.

An advantage of the holding features of the present invention is that one hold down can be used to secure a housing in either a straight through or a right angle orientation. This limits the number of parts that are necessary to keep on hand for both configurations. Furthermore, the hold down can be designed either having a surface mount or through hole securing arrangement. Furthermore, the same housing can be designed to be used in conjunction with the holding feature in either a straight through or right angle orientation, depending on how the contacts are mounted therein.

It is felt that the electrical connector of the present invention and many of its attendant advantages will be understood from the foregoing description. It is apparent that varies changes may be made in the form, construction, and arrangement of parts thereof without departing from the spirit or scope of the invention, or sacrificing all of its material advantages.

What is claimed is:

1. An electrical connector, comprising:

a housing having a mating face, a rear face opposite to the mating face, a side, and an end, the end having a holding feature thereon, the housing being mountable onto a surface of a substrate with either the rear face or the side being placed against the surface;

a hold down securable to the holding feature, the hold down having a substrate securing portion and housing securing portion, the housing securing portion being a C-shaped member and the holding feature of the housing being a protrusion with a groove extending therearound, the C-shaped member being grippingly received within the groove, the housing securing portion being securable to the holding feature in at least two orientations to secure the housing to the substrate when it is mounted in either orientation.

2. The electrical connector of claim 1, wherein the substrate securing portion is a surface mount leg.

3. The electrical connector of claim 1, wherein the substrate securing portion is a pair of resilient legs to engage a hole in the substrate.

4. The electrical connector of claim 1, wherein the protrusion is a square.

5. The electrical connector of claim 4, wherein the protrusion is a circle.

6. The electrical connector of claim 5, wherein a corner of the housing has a corner member to engage a corner of the hold down.

7. The electrical connector of claim 1, wherein the C-shaped member has resilient arms with barbs along inner surfaces thereof.

8. An electrical connector, comprising:

a housing having a mating face, a rear face opposite to the mating face, a side, and an end, the end having a holding feature thereon, the housing being mountable onto a surface of a substrate with either the rear face or the side being placed against the surface;

a hold down securable to the holding feature, the hold down having a substrate securing portion and a housing securing portion, the housing securing portion being a central member having latching arms extending transversely therefrom defining a C-shaped member, the housing securing portion being securable to the holding feature in at least two orientations to secure the housing to the substrate when it is mounted in either orientation.

9. The electrical connector of claim 8, wherein the mounting feature of the housing is a protrusion having latching lugs thereon to engage the latching arms.

10. A hold down for an electrical connector, the electrical connector having a rear face, a side, and an end; the end having a protrusion for engaging the hold down, the hold down comprising:

a housing securing member and a substrate securing member extending from the housing securing member, the housing securing member having arms that engage the protrusion such that the securing member can be mounted on the protrusion in a first direction where the substrate securing member extends towards the side and in a second direction where the substrate securing member extends towards the rear face, the housing securing portion being a C-shaped member and the mounting feature being a protrusion with a groove extending therearound, the C-shaped member being grippingly received within the groove.

11. The hold down of claim 10, wherein the substrate securing portion is a surface mount leg.

12. The hold down of claim 10, wherein the substrate securing portion is a pair of resilient legs to engage a hole in the substrate.

13. The hold down of claim 10, wherein the protrusion is a square.

14. The hold down of claim 13, wherein the protrusion is a circle.

15. The hold down of claim 14, wherein a corner of the housing has a corner member to engage a corner of the hold down.

16. The hold down of claim 10, wherein the C-shaped member has resilient arms with barbs along inner surfaces thereof.

17. A hold down for an electrical connector, the electrical connector having a rear face, a side, and an end, the end having a protrusion for engaging the hold down, the hold down comprising:

a housing securing member and a substrate securing member extending from the housing securing member, the housing securing member having arms that engage the protrusion such that the securing member can be mounted on the protrusion in a first direction where the substrate securing member extends towards the side and in a second direction where the substrate securing member extends towards the rear face, the housing securing member being a central member having latching arms extending transversely therefrom defining a C-shaped member.

18. The hold down of claim 17, wherein the mounting feature of the housing is a protrusion having latching lugs thereon to engage the latching arms.

* * * * *